United States Patent [19]

Kato

[11] 4,429,499

[45] Feb. 7, 1984

[54] REINFORCED BRICK ASSEMBLY

[75] Inventor: So Kato, Seto, Japan

[73] Assignee: Kunishiro Co., Ltd., Japan

[21] Appl. No.: 244,018

[22] Filed: Mar. 16, 1981

[30] Foreign Application Priority Data

Jun. 30, 1980 [JP] Japan ..... 55-90591[U]
Jun. 30, 1980 [JP] Japan ..... 55-90592[U]
Jun. 30, 1980 [JP] Japan ..... 55-90593[U]

[51] Int. Cl.[3] ..... E04C 3/10
[52] U.S. Cl. ..... 52/228; 52/125.4
[58] Field of Search ..... 52/227, 228, 229, 125.4, 52/223 L

[56] References Cited

U.S. PATENT DOCUMENTS 3,112,578 12/1963 Rosenfeld ..... 52/228 X
3,378,969 4/1968 Larger ..... 52/228
3,775,916 12/1973 Bair ..... 52/125.4

*Primary Examiner*—Kenneth Downey

[57] ABSTRACT

This invention relates to a reinforced brick assembly in which a desired number of perforated brick units are piled one above another to form a panel and provided with an arrangement of steel bars for reinforcement of the brick assembly. Further, the weight of each brick unit is lightened by being perforated with a plurality of passable holes for this purpose.

3 Claims, 6 Drawing Figures

REINFORCED BRICK ASSEMBLY

BACKGROUND OF THE INVENTION

This invention relates to a reinforced brick assembly in which a desired number of perforated brick units are piled one above another to form a panel and reinforced by desired arrangement of steel bars and other means.

According to a conventional brick construction, a plurality of bricks are piled one above another and adhered together by mortar. After a certain number of bricks units are adhered together and reach a certain height, a desired amount of concrete is filled between a building wall and a side wall portion of the jointed bricks.

Such conventional brick construction (or so-called masonry construction) has the following defects:

(1) It may be carried out only at a construction site. If a weather condition is unsuitable due to rain or the like, work must be suspended.

(2) Since each brick is heavy, the construction requires much time and labor.

(3) Since no arrangement of reinforcement is made, the flexural strength of such construction is weak. Namely, an aggregate of the bricks piled one above another and jointed with each other under the above construction is liable to be deformed or bent due to unusual forces such as e.g. earthquake.

This invention overcomes the disadvantages of such prior art brick conventional construction.

BRIEF SUMMARY OF THE INVENTION

It is an object of this invention to provide a reinforced brick assembly in which a preferred number of perforated brick units are piled one above another to form a panel and provided with arrangement of steel bars for reinforcement of the brick assembly.

The structure of the reinforced brick assembly, comprises a plurality of perforated brick units, each of which has a plurality of passable holes for inserting vertical steel bars for reinforcement and a large number of passable holes for reducing the weight of the perforated brick unit. The plurality of perforated brick units are piled one upon another in a panel form, and the vertical steel bars are inserted into the passable holes for reinforcement of adjacent upper and lower brick units. Horizontal steel bars for reinforcement are inserted into joint portions between adjacent left and right brick units. Further, a certain amount of mortar is filled into the plurality of passable holes for reinforcement as well as into the joint portions between the adjacent upper and lower brick units and between the adjacent left and right brick units. Further, a top end and a bottom end of the vertical steel bar are fixed with a support plate. Thus, a reinforced brick panel assembly is formed.

It is another object of this invention to provide a reinforced brick assembly which has a very high resistance to unusual outer forces, particularly strength against outward flexure of a side wall of the brick assembly due to steel bars for reinforcement mounted therein.

It is another object of this invention to provide a reinforced brick assembly which is lighter in weight because each brick unit has a perforated structure, whereby brick construction made easier.

It is a further object of this invention to provide a reinforced brick assembly which may be produced at a manufacturing plant and may be easily transported and assembled.

Other and further objects, features and advantages of this invention will appear more fully from the following description.

BRIEF DESCRIPTION OF THE ACCOMPANYING DRAWINGS

DETAILED DESCRIPTION OF PREFERRED EXAMPLES

Preferred examples of a reinforced brick assembly according to this invention will now be described with reference to the accompanying drawings.

Figure 1:
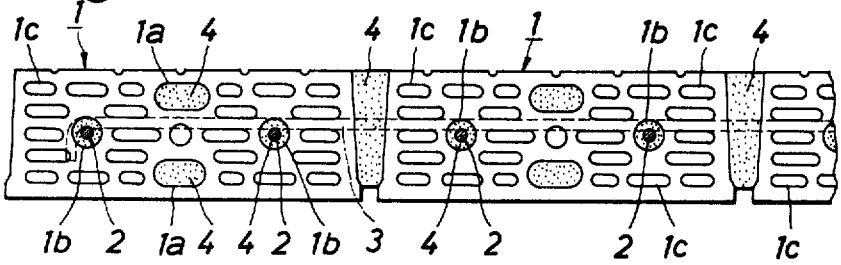
FIG. 1 is a transverse sectional view of an example of a reinforced brick assembly according to this invention.

Referring first to FIG. 1, numeral 1 is a perforated brick unit and numeral 1*a* is a passable hole which is perforated at both a front side of and a back side of the brick unit 1 so that they may oppose each other. Numeral 1*b* is also a passable hole which is perforated at a left side of and a right side of the brick unit 1. Into each of the passable holes 1*b* is inserted a vertical steel bar 2 for reinforcement. Further, a large number of passable holes 1*c* are perforated in order to make lighter the weight of each perforated brick unit 1 and to enhance a heat insulation effect. Numeral 3 is a horizontal steel bar mounted in a joint portion between upper and lower perforated brick units neighboring each other. The arrangement of the horizontal steel bar 3 is made at one's option.

Numeral 4 is a mortar which filled in the passable holes 1*a*, 1*b*, a joint portion between adjacent left and right perforated brick units 1 and between adjacent upper and lower brick units 1.

Figure 2:
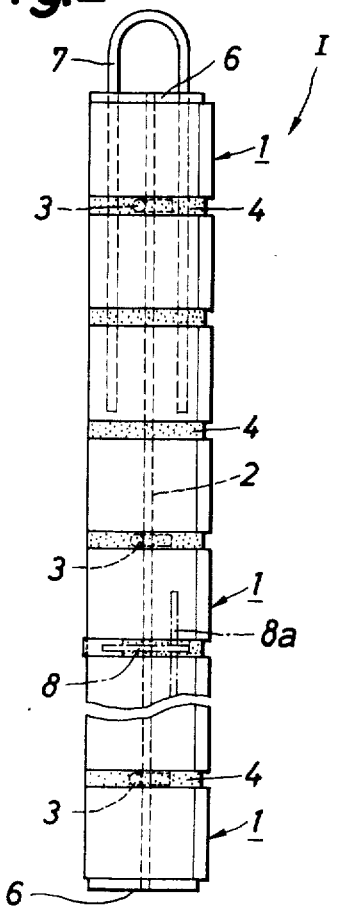
FIG. 2 is a side view of the example in FIG. 1.
Figure 3:
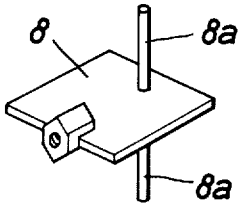
FIG. 3 is a perspective view of an example of support means which is mounted in the reinforced brick assembly of FIG. 1.
Figure 5:
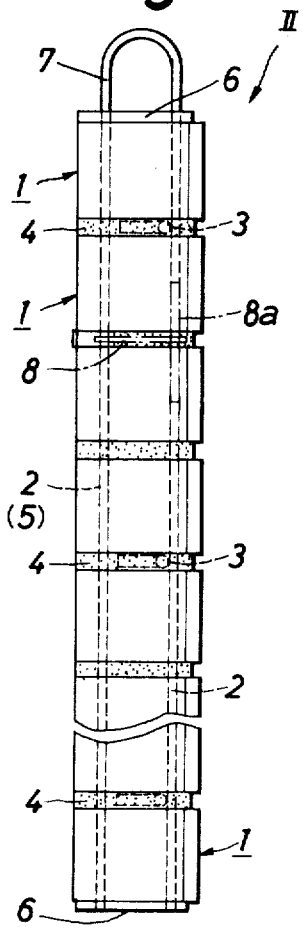
FIG. 5 is a side view of the example in FIG. 4.
Figure 6:
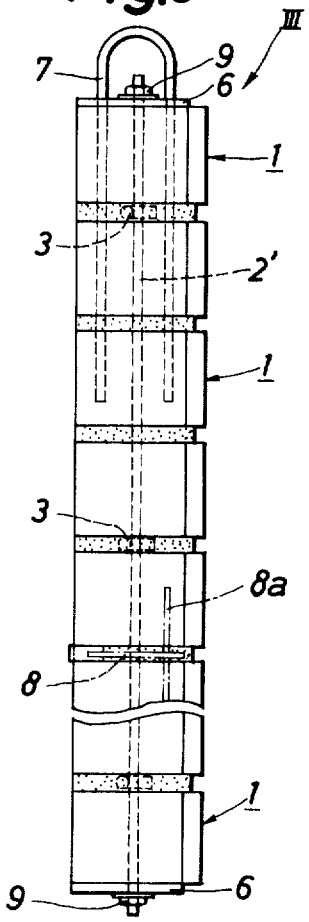
FIG. 6 is a side view of an example of a reinforced brick assembly according to this invention, in which prestressed steel bars are mounted.

Numeral 6 is a support plate for fixing with the uppermost brick unit and the lowermost brick unit. Numeral 7 is a U-shape hook means with its two legs inserted into the passable holes 1*a*, 1*a* as shown in FIGS. 2 and 6. Or, as shown in FIG. 5, the U-shape hook means may be fixed with the support plate 6 mounted on the upper most brick unit. The U-shape hook means 7 is mounted in order to lift a reinforced brick assembly I. The hook means 7 makes brick construction easy and convenient. The support plate 6 is firmly fixed to the hook means 7 by welding.

Numeral 8 is a support means for additionally reinforcing the whole of the brick assembly I. A desired number of support means 8 may be mounted in desired positions as shown in FIG. 2. A vertical leg 8*a* of the support means 8 is inserted into preferred passable holes 1*a* of adjacent upper and lower brick units 1.

Thus, the reinforced brick assembly I is formed in a panel form. For this reason, we may call it a brick panel.

Referring to the properties of the perforated brick unit 1, the perforation rate within one brick unit is about 30% thereof. Due to formation of a larger number of holes 1*c*, the weight of each brick unit 1 becomes lighter. A water absorption rate of it is no more than 8%. Further, in order to prevent the vertical and horizontal steel bars 2, 3 from corroding, a water cement ratio of the mortar 4 is preferably no more than 0.45. The vertical bar 2 and the horizontal bar 3 are for example 10ϕ and 6ϕ respectively in diameter. Those steel bars are treated with dip brazing so that they may have a good corrosion resistance.

Thus, the flexural strength of the whole side wall of the brick assembly I is about three times as great as that of a conventional brick wall having no arrangement of steel bars of reinforcement. Accordingly, the reinforced brick assembly according to this invention has sufficient resistance to a lateral force of concrete which will be deposited between a wall of a structure under construction and the above brick assembly. In other words, it has high safety and durability capable of coping with any unusual outer forces.

Figure 4:
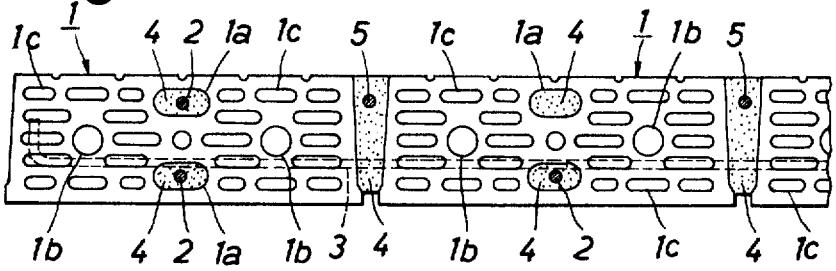
FIG. 4 is a transverse sectional view of an example of a reinforced brick assembly according to this invention.

A second example of this invention will now be described in connection with FIGS. 4 and 5.

In the perforated brick unit 1 according to the second example, two passable holes 1*a* for inserting the vertical steel bar 2 are perforated at both a front side and a back side of the brick unit 1 so that they may oppose each other. Further, one vertical steel bar 5 for reinforcement is mounted in a joint portion between adjacent left and right brick units 1, in which the mortar 4 is filled. Further, likewise in the first example, the horizontal steel bar 3 is mounted in a joint portion between adjacent upper and lower brick units. Still further, a preferred number of the support means 8 are also mounted in a brick assembly II of FIG. 5.

The flexural strength of the whole side wall of the brick assembly II is about five times as great as that of the conventional brick wall having no arrangement of steel bars for reinforcement.

A third example of this invention will now be described in connection with FIG. 6.

In the third example, the vertical steel bars 2 employed in the brick assemblies I and II are prestressed. Namely, they are pretensioned within their elastic limit to give an active resistance to loads. A prestressed vertical steel bar 2' is provided at both ends thereof with a screw portion, and supports firmly the whole of a brick assembly III by way of both an upper support plate and a lower clamping plate 6 which are fixed with bolt and nut means 9. FIG. 6 shows an example in which the prestressed vertical bars 2' are mounted in an example of FIG. 2. Likewise, they may be mounted in an example of FIG. 5.

Further, the horizontal steel bars 3 and a preferred number of support means 8 are also mounted in a brick assembly III.

The flexural strength of the whole side wall of the brick assembly III is about six times as much as that of the conventional brick wall having no arrangement of steel bars for reinforcement.

Needless to say, the number of the above passable holes and of the steel bars in each brick unit and their arrangement may be set at one's option.

As will be understood by the above description, it is one's option to select any one of the above brick assemblies I, II, III. Its decision depends upon the construction conditions.

What is claimed is:

1. A reinforced brick assembly comprising:

a plurality of brick units;

said brick units being stacked in a horizontal and a vertical dimension to form a brick panel;

mortar between adjacent ones of said brick units in said brick panel;

a plurality of holes in said brick units;

at least one of said plurality of holes in at least some of said brick units being aligned with a hole in a vertically adjacent brick unit;

the aligned holes being aligned through at least said vertical dimension of said brick panel;

a vertical steel bar passing in the vertical dimension completely through all of said aligned holes;

mortar in said aligned holes surrounding said vertical steel bar;

a first support plate at a bottom of said brick panel;

a second support plate at a top of said brick panel;

a first end of said vertical steel bar passing through said first support plate and a second end of said vertical steel bar passing through said second support plate;

means on said first and second ends outside said first and second support plates for prestressing said vertical steel bar in said mortar;

at least one horizontal steel bar in said mortar between at least one vertically adjacent pair of horizontal rows of said brick units;

a support means in said mortar between first and second vertically adjacent brick units;

an upper half leg on said support means passing vertically upward into a hole in said first brick unit;

a lower half leg on said support means passing vertically downward into a hole in said second; and mortar in said holes surrounding said upper and lower half legs.

2. A reinforced brick assembly claimed in claim 1, further comprising a U-shaped hook means having first and second legs being affixed by mortar in at least two holes of the plurality of passable holes for reinforcement and being effective to permit lifting the whole of said brick panel.

3. A reinforced brick assembly claimed in claim 2, wherein the U-shaped hook means is affixed to said second support plate.

* * * * *